US007118248B2

(12) United States Patent
Wynne Willson

(10) Patent No.: US 7,118,248 B2
(45) **Date of Patent: *Oct. 10, 2006**

(54) APPARATUS AND METHOD FOR PROVIDING A LINEAR EFFECT

(75) Inventor: Peter David Wynne Willson, London (GB)

(73) Assignee: Wynne-Willson Gottelier Limited, Kent (GB)

( * ) Notice: Subject to any disclaimer, the term of this patent is extended or adjusted under 35 U.S.C. 154(b) by 178 days.

This patent is subject to a terminal disclaimer.

(21) Appl. No.: 10/755,156

(22) Filed: Jan. 12, 2004

(65) Prior Publication Data

US 2004/0141760 A1 Jul. 22, 2004

Related U.S. Application Data

(62) Division of application No. 09/786,457, filed as application No. PCT/GB99/02916 on Sep. 3, 1999, now Pat. No. 6,676,284.

(30) Foreign Application Priority Data

Sep. 4, 1998 (GB) ..... 9819409.5
Nov. 18, 1998 (GB) ..... 9825300.8

(51) Int. Cl.
*F21V 1/00* (2006.01)

(52) U.S. Cl. ..... 362/240; 362/231; 362/251

(58) Field of Classification Search ..... 362/555, 362/240, 231, 800, 552, 246, 245, 545, 558
See application file for complete search history.

(56) References Cited

U.S. PATENT DOCUMENTS

| | | | | |
|---|---|---|---|---|
| 4,607,317 | A | 8/1986 | Lin | |
| 4,976,057 | A | 12/1990 | Bianchi | |
| 5,934,792 | A | 8/1999 | Camarota | |
| 6,676,284 | B1 * | 1/2004 | Wynne Willson | 362/555 |

* cited by examiner

*Primary Examiner*—Ali Alavi
(74) *Attorney, Agent, or Firm*—Kirschstein, et al.

(57) ABSTRACT

Apparatus (11) for providing an output of: (i) electromagnetic waves; (ii) sound waves; or (iii) both electromagnetic and sound waves comprises a power supply, support structure (13), control means and a plurality of transmitters (15) arranged in a linear array on said support structure (13) and in electrical contact with said control means, wherein each transmitter (15) is controllable individually and independently from other transmitters. To provide a coloured lighting effect, apparatus can comprise a first source of light of a first colour, a second source of light of a second colour, different from the first colour and a diffuser (12) for diffusing the light from the first and second sources so that the diffused light from the diffuser is perceived to have different colour, shade or hue. Uses of the apparatus are described, for applications such as entertainment, safety, directional and speed control, such as in providing a linear sound and/or lighting effect in which the output is perceived as emanating from a substantially continuous sound and/or light source rather than from a plurality of individual sources.

18 Claims, 5 Drawing Sheets

APPARATUS AND METHOD FOR PROVIDING A LINEAR EFFECT

This application is a DIV of Ser. No. 09/786,457 filed on May 29, 2001 and now U.S. Pat. No 6,676,284 which is a 371 of PCT/GB99/02916 filed on Sep. 03, 1999.

The present invention relates to apparatus and method for providing a linear effect. The invention relates in particular, but not exclusively, to apparatus and method for providing a linear, white or coloured, lighting effect or a linear sound effect. Very particularly, the invention relates to apparatus and method for providing a rigid or deformable, linear arrangement of light sources capable of producing a wide range of lighting effects.

There are several different types of architectural and display lighting apparatus known, for use in providing lighting displays such as at theatres and outside shops and other retail outlets. Known apparatus include neon and fluorescent lights, rope lights and even more recently the use of optical fibres. All however suffer from a number of disadvantages.

Neon and fluorescent lights are in widespread and almost universal use, and are available in a large range of colours. However, neon and fluorescent lights are rigid and can not have their shape changed according to the changing needs of the user. Further, each individual neon or fluorescent light is typically only available in a single colour. To get a two or more coloured effect requires two or more separate lights.

Rope lights can be made in long, flexible lengths, but as these consist of point light sources at spaced intervals, the light output is not uniform. Rope lights are thus not suitable for many signs. It is possible to chase a limited number of channels in some rope lights, but this is the limit of the effects obtainable. Lastly, while it is known to provide a rope light made up of a number of point light sources of different colours, because of the spacing of individual lights at any one location in the rope the colour of the light is restricted to the colour of the light source in that immediate vicinity.

All of the above mentioned lights, neon, fluorescent and rope lights, require high voltages, with the result that in certain circumstances, particular health and safety factors have to be taken into account when using such lights.

A number of illuminated display systems are known that use LEDS in two dimensional pixelated displays, individual LEDS or groups of LEDS being under independent control. Examples of such displays include those described in U.S. Pat. Nos. 4,845,481, 4,887,074, 5,134,387, 5,184,114, 5,410,328 and 5,420,482. Entertainment and other uses of these displays is rather limited.

Optical fibre offers the prospect of a lighting effect in which the fibres themselves are voltage free. Nevertheless, the light source itself when operating is hot and at high voltage. In addition, light intensity fades along the length of the fibres and the fibres themselves have a poor light output which is of limited application. A colour may be selected at the source but that colour will be the same along the length of the fibre.

Another LED-based lighting apparatus is the subject of WO-A-99/10867, published after the priority date of the present application, in which LEDs are used as light sources to replace, e.g. incandescent sources in spotlights and torch lightbulbs.

It is conventional in aircraft and on ships to provide emergency routing systems to direct passengers to exits in the event of fire or another emergency. On aircraft, this emergency routing is typically provided by a linear array of lights, but their output which is of fixed colour may be dim and rapidly be obscured by smoke in the event of fire. Emergency routing systems are known on cruise ships, but these tend to be static displays, giving no indication of the direction in which passengers should proceed to find the exit. These types of emergency lights also suffer from dim output and are likely to be invisible in thick fog or smoke.

It is thus an object of the invention to provide method and apparatus for providing a linear effect that, at least in preferred embodiments, avoids or ameliorates problems such as those identified in prior art lighting and routing systems, and to provide a new tool for lighting designers, architects, sound engineers and all others involved in display, architectural, safety or entertainment lighting, or sound effects.

Accordingly, the invention provides apparatus for providing an output of electromagnetic and/or sound waves, comprising:

- a power supply, or means for connection to a power supply;
- support structure;
- control means; and
- a plurality of transmitters arranged in a linear array on said support structure and in electrical contact with said control means;
- wherein each transmitter is controllable individually and independently from other transmitters.

The array of transmitters is a linear array in that the transmitters are arranged in a long line one after the other, though each is typically in close proximity to the next transmitter in the line. The linear array may be rigid or flexible and is optionally deformable so that it can be deformed into a shape desired by the user. The array is preferably substantially one dimensioned in that flow of output from adjacent transmitters can indicate direction only in one dimension, such as left-to-right or right-to-left.

The transmitters are optionally selected from transmitters of electromagnetic radiation and transmitters of sound, including sound both in the audible and ultrasonic ranges. In embodiments of the invention in which the transmitters are for transmitting electromagnetic radiation, this radiation may be of substantially any wavelength in the electromagnetic spectrum, including gamma rays, X-rays, UV light, visible light, IR light, microwaves, and short-, medium- and long-wave radiowaves. It is preferred that both the wavelength and the intensity of the output from each transmitter can be individually varied, providing the apparatus with a wide range of outputs.

In a specific embodiment of the invention described below in more detail, the transmitters are light sources. The transmitters may further optionally be transmitters of sound waves, and may thus be transducers for converting electrical signals from the control means into sound. Again, it is preferred that the sound output from each transducer has both variable pitch and variable volume. By way of example, they may be d.c. buzzers (operating on direct current).

Reference to a plurality of transmitters indicates preferably that the apparatus comprises at least 10 transmitters in a linear array, and further preferred embodiments of the invention comprise at least 30, 50 and, more preferably, at least 70 or 100 transmitters in a linear array. These transmitters are typically arranged in close proximity to each other so that at distance from the apparatus the output of two or more adjacent transmitters is perceived to be a substantially continuous output from a single elongate transmitter rather than output from discrete individual pixel-like transmitters.

In typical use, and especially when output is being flowed along the apparatus, the distance of an observer or listener or of detecting means from the transmitters is such that the output from an individual transmitter diffuses into the output of the next or of an adjacent transmitter so that the respective individual outputs can not be, or can hardly be, distinguished and the output is instead perceived as an narrow, elongate, linear output. The amount of diffusion to achieve this effect varies with inverse proportion to the distance from the output, typically tending to completely diffused and mixed outputs at long distance. It is optional for the apparatus further to include a diffusing surface or medium to enhance the diffusion. In the case of light, the human eye can distinguish point sources at relatively large distance and a diffuser may include a translucent diffusing substrate placed around or in front of the sources and at sufficient distance from the individual light sources so that the output from the diffuser is perceived as substantially homogeneous and non-pixelated. In the case of sound, the human ear can not so accurately distinguish between point sound sources and with the sources located sufficiently close together a diffused single output will be perceived.

The control means in electrical connection with each of the transmitters is able to control the output of each transmitter individually. The apparatus is thereby able to provide a wide range of effects. The output of transmitters can be flowed along the length of the apparatus from one transmitter to the next so that the output is perceived to move linearly along the array of transmitters. This flow of output can give the impression of movement or direction or both movement and direction, and is advantageous in directing an observer in the direction of perceived movement of the output. This effect is achievable if the control over each individual transmitter is the ability merely to turn each transmitter individually on or off.

It is preferred that the control means is able also to vary the intensity of output from each transmitter. If the intensity increases from transmitter to transmitter along the length of the apparatus, then this again can impart directional information to an observer. For example, an increase in volume of sound output or of brightness of light along the length of the apparatus can be used to direct an observer to the point of loudest volume or brightest light which may be located at an emergency exit.

It is also preferred that the control means can vary the frequency of electromagnetic waves output from the transmitters or can vary the frequency of sound waves output from sound transducers. Varying the frequency in this way is an alternative means of imparting movement and/or directional information. For example, an increase in pitch can be used to indicate the direction of an emergency exit.

It is further preferred that the control means includes a memory in which are stored the control signals for one or more preset outputs from the apparatus. One such preset output is a pattern of on and off switching of transmitters so as to flow the output along the apparatus. In use, this pattern is selected by an operator and the output is flowed along the apparatus by the control means reading from the memory the stored pattern of signals needed to achieve this effect. Another preset output is, in the case that the apparatus comprises light sources of different colours, a series of outputs whereby the combined transmissions of different coloured light sources provide a choice of colours greater than the number of colours of individual light sources. In use, a colour is selected for the whole or a subsection of the apparatus and the light sources that are to operate and level of illumination for each needed to obtain that colour is read from the memory.

The support structure suitably is composed of or comprises a circuit board, such as a printed circuit board, through which electrical connections from each of the transmitters to the control means may be made, and optionally the power supply connected. It may be integral with a further base unit on which other optional components of the apparatus, including a diffuser, cover or shield to protect against abrasion or connectors for surface mounting, may be located.

The wide range of outputs available from the apparatus and the control achievable by each transmitter being individually addressable provides apparatus with a wide range of advantageous uses and applications.

In an embodiment of the invention, the apparatus is laid on or incorporated into a road surface and output from the transmitters is used to guide driver-less vehicles along the course followed by the linear apparatus of the invention. Variation in output of individual transmitters is used to vary speed of the driver-less vehicles. Generally, flow of output along the apparatus can be used to control traffic and/or speed, e.g. via incorporation into road lanes.

In another embodiment of the invention, the transmitters are transducers for outputting sound. These may optionally be piezoelectric loudspeakers. This apparatus is advantageously laid along emergency routing corridors in aircraft or ships and, in operation, guides passengers towards emergency exits and without being obscured by smoke. As previously mentioned, flow of sound and/or light along the length of the apparatus is conveniently used to indicate the direction of the emergency exit, and alternatively variation in pitch of output indicates direction of the exits. Another suitable use of the invention is for sound effects within an auditorium. A length of apparatus is laid around the walls of an auditorium and sound and/or light can then be flowed around the auditorium given the effect of movement to the listeners.

In a still further embodiment, the invention provides apparatus for providing a lighting effect, comprising a plurality of light sources in close proximity to each other so that the diffused light is perceived to be not from a plurality of light sources but from a single, substantially continuous source.

The light sources are located sufficiently close to one another that in use a viewer can not distinguish light from individual sources but instead perceive a near-continuous light output as if there were one substantially continuous elongate light source. An apparatus of the invention in which all light sources are of the same colour thus typically gives the same appearance as a neon tube of that colour. An apparatus of the invention in which light sources are of different colours can output light which whilst being a mixture of different colours is perceived as a single colour. The apparatus further preferably comprises a diffuser for diffusing the light from the plurality of light sources, suitably at sufficient distance from the individual light sources so that the output from the diffuser is perceived as substantially homogenous and non-pixelated.

A first specific aspect of the invention provides apparatus for providing a coloured lighting effect, comprising:

a first source of light of a first colour;

a second source of light of a second colour, different from the first colour; and a diffuser for diffusing the light from the first and second sources so that the diffused light is perceived to have different colour, shade or hue.

In operation, the apparatus advantageously outputs light perceived as of the first colour or of the second colour or, when both first and second sources are operating, of a different colour shade or hue, being an admixture of the two colours. By mounting separate sources in close proximity to one another and in a repeating, linear arrangement, the apparatus in use can output light of a variety of colours, shades or hues with substantially uniform output.

The apparatus preferably comprises at least red, green and blue light sources and also, optionally, white light sources. By operation of all or a selection of these sources in a simple on/off manner, the user has the choice of seven colours, and including white light further increases the light output options for the user. This is a significant advance over prior art neon tubes in the range of colours available from a single apparatus. It is further preferred that individual sources can be modulated or dimmed so that each can have more than one level of intensity of output, increasing the range of effects available and increasing the control over colour so that many more colours are available to the operator.

In a preferred embodiment of the invention, the apparatus includes means for individually addressing each light source whereby control of one or more light sources creates a static or moving coloured lighting effect. The apparatus may further comprise an elongate diffuser along the length of the apparatus, and a wide range of lighting effects are thereby obtainable. Different sections of the apparatus can output different coloured light. The whole apparatus can output light of one colour and be changed so the whole apparatus then outputs light of a different colour. Colours can be flowed along the apparatus and different colours can be chased along the apparatus. The light sources of the apparatus further are preferably substantially surrounded by diffusing or non-translucent material, so that substantially no light is output from the apparatus other than via the diffuser. This arrangement prevents the lighting effect being spoiled by non-diffused light contaminating the output of the apparatus.

A second specific aspect of the invention provides apparatus for providing a lighting effect, comprising a plurality of light sources all of the same colour and located in close proximity to each other, and a diffuser for diffusing the light from two or more of said light sources so that the diffused light is perceived to emanate from a substantially continuous light source and not from individual light sources.

This aspect of the invention thus provides a single colour apparatus, which single colour is suitably selected from any colour and can also be white.

Control of each light source independently is conveniently achieved using a processor. The apparatus may include means for connection to circuitry for control of illumination of the light sources, such as an RS232 computer interface. The apparatus may itself include a processor which is programmed to control each light source independently, integral with the apparatus. A number of preprogrammed routines are conveniently included in the processor.

The apparatus of a specific embodiment of the invention described in further detail below comprises a repeating linear array of differently coloured light sources, wherein the sources are mounted on a circuit board in close proximity to each other and light output from the sources passes through a translucent diffuser running substantially the length of the apparatus.

The light sources are arranged so that at a distance from the diffuser the viewer perceives output from the diffuser to be substantially even as if the light is not emanating from point sources but from an elongate continuous or near-continuous light source. When sources of different colours are operating, the viewer perceives diffused light of a single colour shade or hue, rather than finite individual light sources of different colours in close proximity. The light sources are suitably selected from LED, incandescent, discharge, electro-luminescent, xenon-type flash or any other convenient light source emitting radiation.

The diffuser may be made of translucent, diffusing material so mounted that light output from the apparatus passes through the diffuser before being perceived by an observer. The diffuser may thus substantially surround the light sources and be tube-like. Polymers such as PTFE and polyethylene are suitable. The diffuser may alternatively be or comprise a reflector mounted below the light sources. Light output is reflected and diffused by the reflector. Some light may be output directly without being diffused but the overall effect is to provide light output perceived as substantially continuous and/or an admixture of different colours. Alternatively, an opaque member prevents output of light other than via reflection and diffusion by the reflector.

In a specific embodiment of the invention described below in further detail, the light sources are light emitting diodes (LEDs). An advantage of this embodiment of the invention incorporating LEDs is that these typically require a low operating voltage, thereby avoiding the health and safety considerations associated with operation of high voltage equipment. This significantly increases the flexibility and ease of installation and use of the apparatus of the invention. The light output of high intensity LEDs is bright, and LEDs have a long life, thus the apparatus is for use in a wide range of lighting effects, and is suitable for use in display, architectural and entertainment lighting. The light output can be comparable to that of neon and fluorescent tubes, and thus apparatus according to the invention is suitable for all applications where neon and fluorescent lights have hitherto been of choice. Further, the output is substantially uniform along the length of the apparatus. The LEDs may further be mounted at varying angles between fully upright and 90° to the vertical, typically at from 15° to 60° to the vertical, to maximise the light output. Likewise spacing of LEDs can vary. The normal viewing angle of LEDs is quite narrow, being around 60°. Mounting the LEDs at an angle increases the overlap between output of adjacent LEDs and thus with angled LEDs the evenness of output is improved and/or spacing between LEDs can be increased.

It is a further option for components of the apparatus of the invention, such as comprising light sources and diffuser, to be deformably mounted together so that they can be configured into a required display shape, such as by mounting them on deformable support structure. One particular embodiment of the apparatus has a deformable tubular diffuser partially or wholly surrounding a row of LEDs, which can the be deformed into a desired shape, for example into wording for a sign, into a lighting effect around a doorway, or to run in a long line around the outline of a window or building. This offers an improvement over prior devices as the apparatus of the invention can be deformed into different shapes and configurations, whilst having the colour mix, change, flow and chase options already discussed.

It is also optional for the apparatus to be configured so that lengths can be chained together to form longer apparatus. The distal and proximal ends of the apparatus may comprise electrical connections, so that a plurality of apparatus can be connected together. Preferably, the apparatus includes electrical connections for connection of the apparatus to a power supply, whereby in a chain of a plurality of apparatus, each or a number of the apparatus can be separately connected to a power supply or power supplies. The control signals may be similarly connected. Each individual length of apparatus may comprise at least 20 or more preferably at least 50 transmitters. Chaining lengths together can provide many hundreds of transmitters in a linear array.

In an example of the invention in use, apparatus comprising a plurality of light sources is used to indicate an emergency exit route. Changes of colour can indicate the level of emergency according to the severity, such as amber for medium and red for full emergency evacuation procedures. Flow of output from light sources along the apparatus is preferably used to indicate the direction of the exit and variation in colour is conveniently used to indicate distance from the exit, the colour changing as the exit is approached.

It is particularly preferred that the transmitters in apparatus of the invention comprise both light sources and transducers that output sound. Apparatus of the invention may thus provide both sound and light output with all of the flow, chase and frequency variation effects discussed.

In another example of the invention in use, and apparatus comprising a plurality of light sources is laid on or along side or incorporated into a road surface. Flow of output from light sources is controlled so as to assist control of speed of the traffic. Thus, flow of light along the apparatus at, say, 50 mph (approximately 80 kph) assists in restricting the speed of cars and other vehicles. Controlled decrease in the speed of flow of light output along the apparatus can assist in obtaining a controlled deceleration of traffic, avoiding accidents due to compression of waves of traffic and sudden changes of speed. An alternative use is for apparatus of the invention outputting light to be used to define lane boundaries, for example in separating lanes in a motorway or a swimming pool. In the latter case, speed of flow of output can provide guided speed for swimmers following a particular training regime. A further example of the invention in use is for apparatus of the invention outputting light to be used around the periphery of a roundabout to indicate correct direction of traffic flow.

The invention also provides a method of providing a linear output of electromagnetic and/or sound waves, comprising:

mounting a plurality of transmitters in a linear array; and controlling the output of each transmitter individually.

Independent control of each transmitter enables a wide range and variety of effects to be obtained. The nature of the transmitters and control thereof is as described elsewhere herein. For example, the method may comprise flowing or chasing the output of the transmitters, and may comprise varying the frequency or intensity of output.

The invention also provides, in a particular embodiment, a method of providing a lighting effect, comprising:

mounting on one side of a diffuser, a linear array of light sources of the same colour;

outputting light from a plurality of said sources simultaneously and via the diffuser;

wherein the light sources and diffuser are so arranged that light from the sources is diffused by the diffuser and perceived by a viewer as emanating from a substantially continuous light source rather than from a plurality of individual light sources.

The invention further provides, in another specific embodiment, a method of providing a coloured lighting effect, comprising:

mounting on one side of a diffuser, a linear array comprising first sources of light of a first colour, and sources of light of a second colour which is different from the first;

outputting light from light sources of first and second colours simultaneously and via the diffuser;

wherein the light sources and diffuser are arranged so that light from the sources is diffused by the diffuser and perceived by a human eye as a substantially continuous light source containing or consisting of light of a different colour, shade or hue.

Preferably the array further comprises sources of light of a third colour different from the first and second colours, wherein the light sources are arranged so that when any two or more of the light sources are operating, light from the sources is diffused by the diffuser and perceived by a human eye as containing or consisting of light of a diff rent colour, shade or hue.

The invention additionally provides a method of making a lighting display, comprising mounting, on deformable support material, a diffuser and a plurality of differently coloured light sources, wherein light from the sources is diffused by the diffuser and perceived as a different colour, shade or hue.

It is an advantage of the invention that by combining different colours of light sources, the range of colours that can be output is not limited to the individual colours of the light sources but also includes combinations of different colours. Thus, using red, green and blue light sources, a choice of seven colours may be obtained.

Control of output of the individual transmitters enables a wide range of effects to be achieved as has already been described above. Control of the individual transmitters is conveniently achieved using computer software with an RS232 or other suitable interface with the apparatus. It is optional to provide in the computer software a number of pre-programmed display effects, such as scrolling through the different outputs, such as colours, available, chasing the output of transmitters along the length of the apparatus and outputting different frequencies from different sections of the apparatus. The method may also comprise storing one or more preset patterns of operation in a memory and reading that memory to output the desired pattern.

The material of the diffuser, and the material of the flexible support material where this is separate from the diffuser, is suitably of waterproof plastic material, thus providing a low voltage, waterproof apparatus particularly suited to outdoor use.

Other optional arrangements and configurations are also suitable for the apparatus and method of the invention. The transmitters may be arranged in parallel or staggered lines of similar or different transmitters, one line being a line of light sources and another a line of sound transducers, or along a single line light sources may alternate or otherwise interleave with sound transducers. The transmitters may be mounted on or connected to a printed circuit board which optionally is deformable or folded along its length in order to reduce the overall depth of the apparatus. The transmitters may be mounted substantially in the same plane as the printed circuit board or in a plane perpendicular to that of the printed circuit board.

A further option is for the transmitters, printed circuit board and diffuser to be deformably mounted together and enclosed within a plastic extrusion. In a further embodiment, it is an option for the second, separate diffuser to be attached to the apparatus. An alternative is for the transmitters, PCB and diffuser to be deformably mounted together and co-extruded in a diffusing material.

In an example of the apparatus in use, the apparatus may advantageously be adapted for attachment to temporary structures such as barriers, including road barriers, or traffic cones.

Individual lengths of apparatus of the invention may be connected together, suitably via electrical connections for power and/or control signals at their respective proximal and distal ends. The power and/or signal conductors may be arranged so as to be available for insulation displacement connection. The conductors may be arranged so as to be available for connection to local input from sensor devices, such as thermometers, anometers, smoke or gas detectors, strain gages or similar such devices. The conductors may be arranged for connection to local input from emergency services equipment, suitably for use in traffic or crowd control. The device may further comprise circuitry to receive and decode telemetric signals.

The apparatus may further comprise one or more solar cells and may further comprise one or more electrical storage devices, such as rechargeable batteries, integrated into and between the individual transmitters. These are of particular advantage in long term outdoor use such as in traffic and architectural uses of the apparatus.

In a specific embodiment of the invention, the apparatus is in the form of a flexible tube approximately 25 mm–100 mm (1–4 inches) in diameter and is available in lengths which can be chained together to provide a total length of up to 100 meters. Power supplies can be placed periodically along the length of such a chain, and the chain is flexible enough to bend through a radius of 150 mm (6 inches) without failure of operation. Red, green and blue LEDs are provided, and operation of these is via a simple control panel with options to set the colour, flow speed, direction and pattern of illumination of the LEDs. A number of pre-programmed patterns and chases may be selected by the user, and the control panel includes the option for new patterns to be programmed in via a PC interface. The control panel operates at 100–240 volts dc, 50/60 Hz, whilst the apparatus itself runs at no greater than 30 volts dc.

Apparatus and methods of the invention are thus suitable for providing directional and/or active, moving output, for indication of direction and/or speed and for control of direction and/or speed. The appearance can be given of a light or sound source that is moving. Flexible support structure enables a linear device of the invention to be conformed to any desired shape, e.g. to follow any given line or profile. In an alternative embodiment, one or more or all transmitters are replaced by sources of olfactory material, under individual control as per other embodiments.

Transmitters are preferably arranged in an elongate, linear array having transmitters arranged in a line one or two transmitters wide and many transmitters long, preferably one transmitter wide.

A further option is to attach, permanently or removably, one or more overlays to the apparatus, e.g. onto the diffuser. These can be text or graphics and be made of opaque, transparent or translucent material. This option adds further to the applications and effects possible using the invention.

A still further option lies in a method of control of transmitters in apparatus of the invention, comprising:

providing a linear array of the transmitters in a predetermined conformation;

creating a pixelated image comprising the linear array;

mapping a pixel in the image to a transmitter in the linear array;

directing operation of the transmitter by selection of the pixel corresponding thereto.

An example of such a control system is used for controlling a linear string of LED illuminants. The LEDs are placed in a linear string in groups of threes one red, green and blue in each group, with individual control of the brightness of the lamps so that any resultant colour can be generated at any point along the length of the string. The method for control is based on the principle of scanning a static image. Any source image can be used and is prepared in a binary format, with the number of vertical pixels matching the number of groups of three LED's, and the colour depth matching the capability of the control system to define light intensity. Individual vertical lines of pixels are extracted from the binary image file and mapped onto the LED string. This process is carried out sequentially moving backwards and forwards across the image so that each pixel column is mapped in turn onto the LED string. By suitable choice of original image and by adjusting the rate that the image is scanned, a great variety of aesthetically interesting effects are generated along the LEDs. For example an original image consisting of multi-coloured zig zag lines will be converted into a wave like motion of groups adjacent to LEDs being illuminated. Alternatively, if a photograph of an easily recognised subject is chosen, the scanning process will hide the subject matter but retain the colours.

The invention is described in specific embodiments with reference to the accompanying drawings in which.

Figure 1:
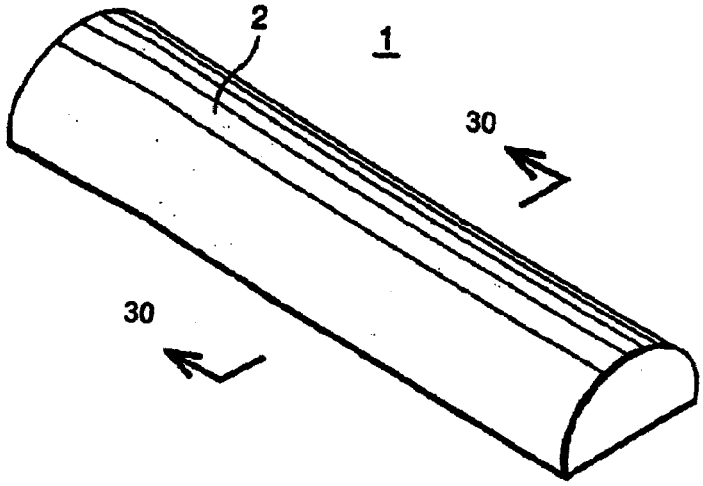
FIG. 1 shows a schematic isometric view of apparatus of the present invention.
Figure 2:
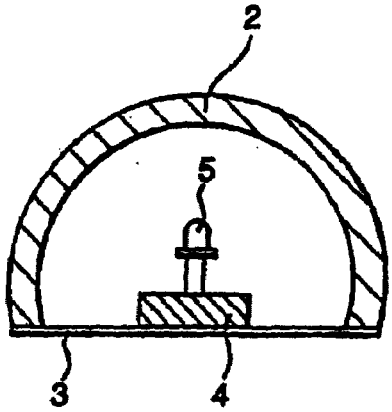
FIG. 2 shows a schematic cross section along line 30—30 of FIG. 1.
Figure 3:
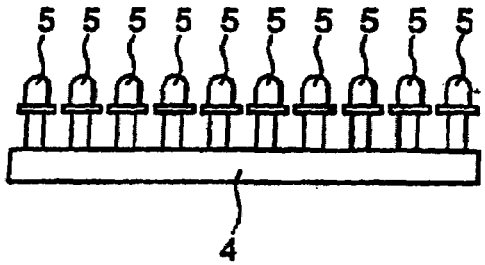
FIG. 3 shows a schematic cut away view of a portion of the apparatus of FIG. 1.

Referring to FIGS. 1, 2 and 3, apparatus of the invention is shown generally as 1 (and referred to also as "flow light") and comprises an elongate diffuser 2 made of rigid, translucent diffusing plastics material. The diffuser is mounted on base 3 which supports also a printed circuit board 4. The printed circuit board is connected to controlling electronics and power supplies, not illustrated in FIGS. 1–3.

A linear array of LEDs 5 is mounted on and electrically connected to the printed circuit board. The LEDs are in close proximity to one another and are in a repeat pattern of red, green, blue, red, green, blue etc along the length of the flow light. Each LED is individually controlled so that each can be turned on or off at will and each can have its brightness varied independently of all the other LEDs. The diffuser in combination with the base completely surround the LEDs and consequently light can only be output from the apparatus via the diffuser. In operation, when a plurality of the LEDs are illuminated, light from these is diffused and perceived by a distant viewer as emanating from a continuous linear light source rather from individual point light sources.

The apparatus of the present invention is hence an optical effect system consisting of an array of multiple optical emitters (light sources) on a regular pitch with control electronics individually to control each source. The source of illumination at each emitting site is incandescent light emitting diode, which can be gas discharge or fluorescent, and in the rest of the text these emitters will be referred to as LEDs.

Figure 4:
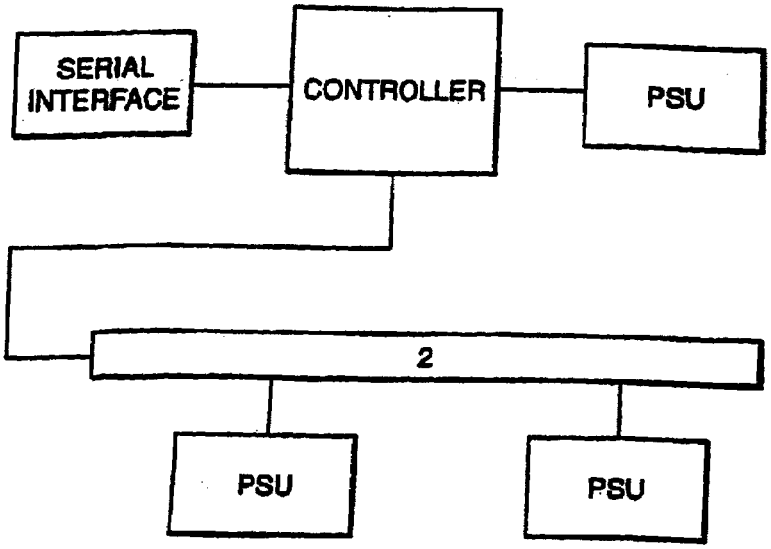
FIGS. 4–8 show schematic diagrams of the apparatus and its controlling electronics and power supplies.

A length of floline, along with its power supplies, a controller and its power supply are schematically illustrated in FIG. 4.

By controlling the information sent by the controller to the LEDs drive electronics it is possible to control individually the illumination of each source. Varying the timing of illuminating adjacent sources gives the effect of apparent motion to the output of the apparatus. The array of LEDs are multiple colours, in a repeating red, blue, green sequence along the length of the apparatus and enclosed within the diffuser, though it is also an option for the multiple colours to be arranged in groups. The LEDs are tightly located one next to another so that when two or more are illuminated in close proximity the perception of the viewer is that the light output from the diffuser is continuous—i.e. a colour that is an admixture of the individual LEDs or in the case that all LEDs illuminated are the same colour, a continuous coloured output.

The electronics are controlled to light the LEDs in a programmed manner, and patterns available include the source for the control information being a regular on off sequence or complete states can be output at a controlled rate.

If LEDs states are output with small changes between them it is possible to give the eye the impression of movement. If the group of 4 states is repeated:

| | | | |
|---|---|---|---|
| on | off | off | off |
| off | on | off | off |
| off | off | on | off |
| off | off | off | on |

then a display of three off one on will ripple along the apparatus. To further enhance the display, the intensity for each emitter is varied.

The controlling electronics of the apparatus consists of the controller, its power supply and the assembly of LEDs and one or more power supplies for the LEDs. Because the power consumption of the LEDs is high it is currently necessary to feed power into the linear array of light sources at regular points. The distance between these points is determined by the size of the power conductors, the current consumption and the degree to which the voltage drop affects the light emitted.

Figure 5:
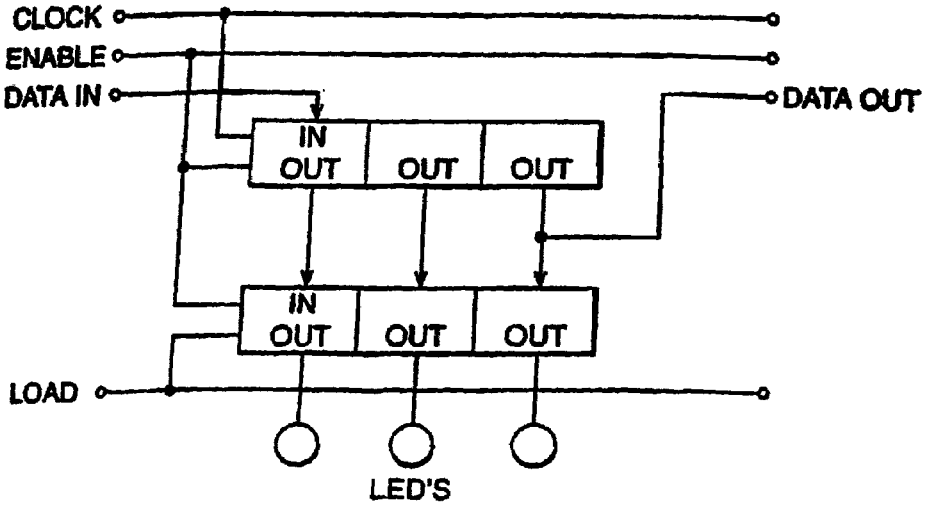

The controller is responsible for outputting data sequentially to the LEDs. This data stream is placed in a temporary store attached to each LED allowing time for all the control information to be scanned out. A single control signal can then transfer the data to a second store that is used to drive the LED. This arrangement can be implemented in several ways. The first is to have a shift register into which the data can be clocked, with the outputs of each stage being connected to a storage latch with a load input as in FIG. 5.

Figure 6:
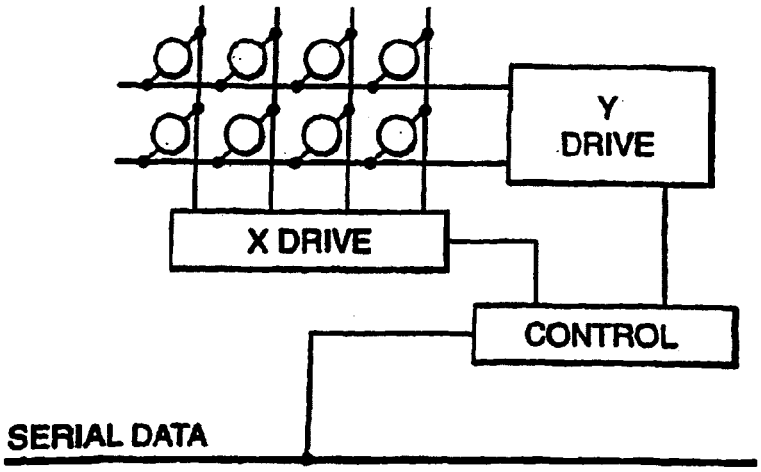

The same result is achieved by having the electronics receive the data for a set number of LEDs and then store this information until a load command is received. At this point the new information is output to the emitters arranged in a matrix and scanned sequentially by the electronics, as in FIG. 6.

The controller itself is a microprocessor controlled unit with a CPU, RAM and EPROM or Flash EPROM to store both the program and data images. Also attached to the CPU are a serial interface to connect to external programming equipment and the interface to the apparatus itself.

Figure 7:
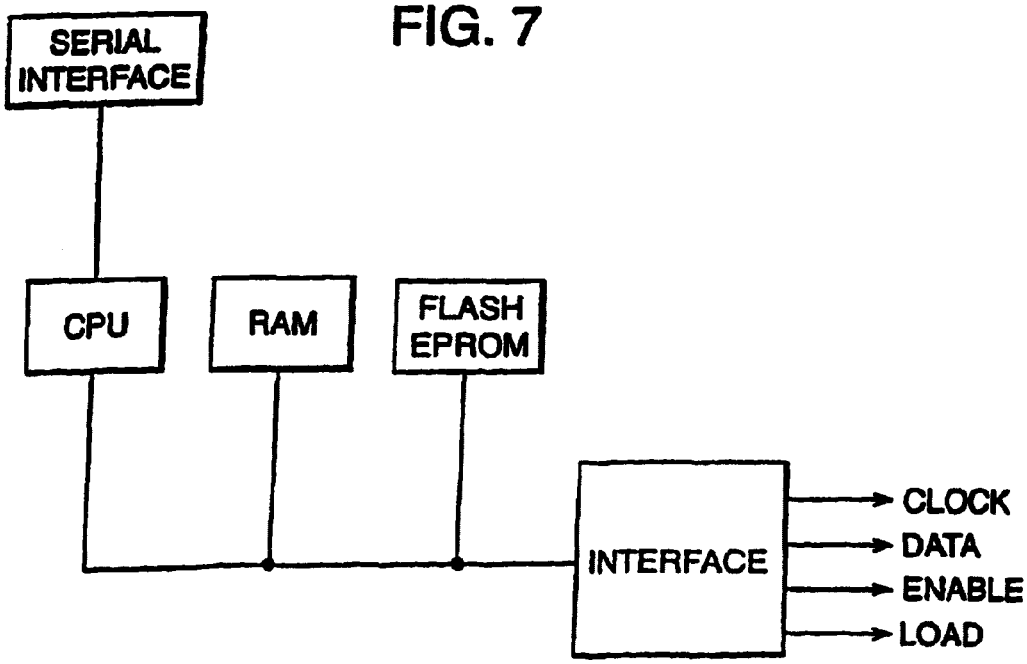

FIG. 7 shows a controller in block format. The interface to the floline was configured to drive the shift register system.

For this there is a data output line along with a clock line. When the data on the data out line is stable the state of the clock line is changed to shift the data into the shift register. All existing data is then moved along to the next register. When the shift register is loaded with the desired bit image a load control line is activated to transfer the data from the shift register temporary store to the output store. At this point the new data will control the LEDs. Finally there is an enable line to turn off all the output drivers so the display can be extinguished. This can be used for controlled starting when power is applied to prevent odd data being visible, to flash the display on and off and finally connect to a system monitoring device so it can turn off the display if the controller has a failure.

The clock and load control lines connect to all the LED emitting sites hence they have a large load on a long system and must be buffered at regular intervals. This is conveniently done at the points at which power is supplied to each section. For EMC compliance the edges of these signal are controlled to limit the amount of RFI energy emitted.

In an alternative drive method, the controller has a second serial port and the data for each section is output on this. Means for each section to identify which data it is to use is also added.

An external interface serial port is another option, and allows reprogramming of the Flash EPROM with new image data. This could be downloaded from a personal computer for example.

Colour is handled in several ways. One way is for each emitting site to have a number of individual coloured sources each with its own drive electronics. Each colour has its own shift register and holding latch and the number of data outputs on the controller would increase. The clock and load lines are common to all shift registers.

The other possibility is to have either section of the apparatus in different colours or to have the LEDs in sequential colour order—for example red, green, red, green, red and so on. This makes the spacing between each similar colour increase. The programming would then take care of which colour to use. An advantage of this approach is to keep the electronics to a single shift register.

The brightness of each LED can also be controlled. In the same way as in the control of colour, multiple shift registers can be used with each giving a proportion of the drive, ie 2 shift registers would give 3 brightness levels plus off, 4 possible states. If one LED is driven by a number of outputs on one shift register then again brightness can be controlled.

Overall brightness can be controlled either by varying the supply voltage to the displays or by switching them on/off at high speed so that the ratio of on to off time (mark to space) determines the brightness. This needs careful design to limit the EMC problems of switching high current at high speed.

Figure 8:
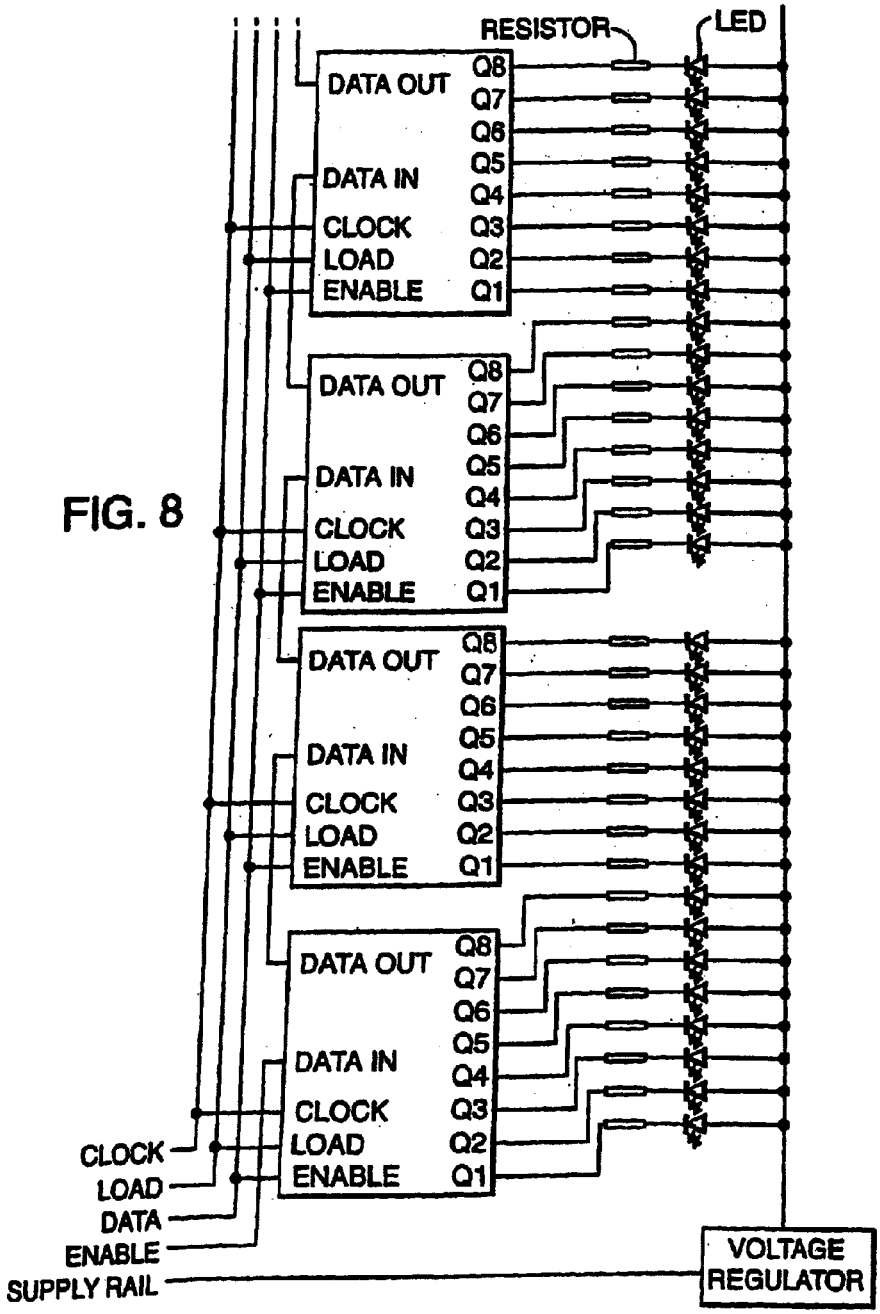

A typical set of drive lectronics that is packaged with the LEDs is shown in FIG. 8.

While this present example has been described in relation to an apparatus incorporating light sources, an alternative embodiment of the invention comprises transducers that output sound and are controllable by similar electronics. Supplying the positive side of the LEDs shown in FIG. 8 with a modulated audio source provides the same effects in one audio tone as apparatus having LEDs of one colour.

Figure 9A:
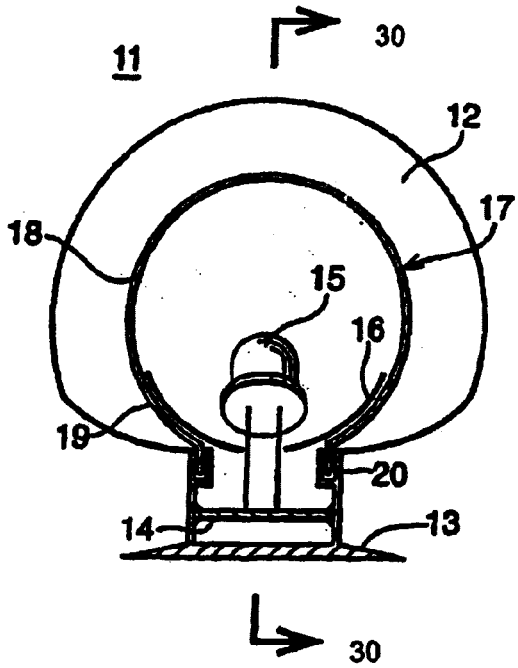
FIGS. 9A–9B show schematic end-on and partial cross-section views of further apparatus of the present invention.
Figure 9B:
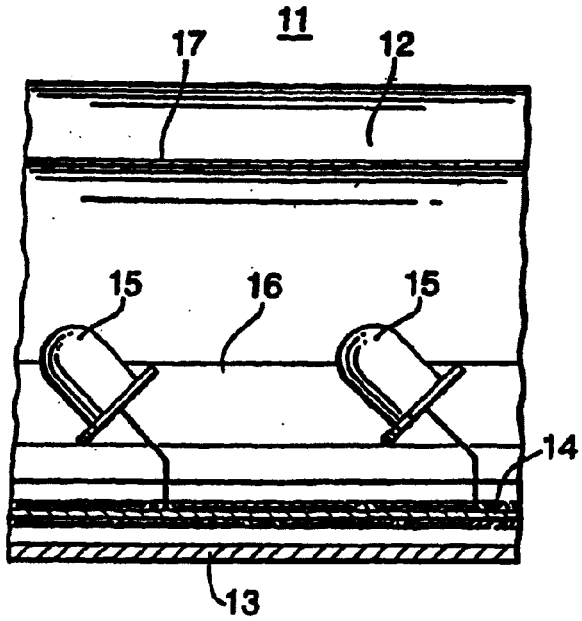

Referring to FIGS. 9A, 9B, a further apparatus of the invention is shown generally as 11 and comprises an elongate outer diffuser 12 mounted on base 13. A printed circuit board 14 is also mounted on the base and connected to controlling electronics and power supplies, not illustrated in the figure.

A linear array of LEDs 15 is mounted on and electrically connected to the printed circuit board. The drawing is rather schematic, with the spacing of LEDs being exaggerated for convenience. Operation of and choice of colour of the LEDs is as previously described.

The LEDs 15 are mounted so as to be at an angle of about 45° to the vertical, in the direction of the longitudinal axis of the apparatus, as shown in particular by the cross-sectional view on 30—30. There is also mounted on the base a reflector 16. This is located underneath the LEDs and extends part way up the inside of the tunnel created by the diffuser. The reflector serves to help maximize light output by reducing light loss, e.g., by absorbance in the PCB. Angling the LEDs serves to assist in providing even output from the apparatus.

Also mounted on the base is inner diffuser 17 having translucent upper portion 18 and lower portion 19 which locates into slot 20 on the base. The inner diffuser is typically of different material from the outer diffuser and 3M's Optical Light Film as used in their "Light Pipe" (registered trade mark) mounted on a substantially transparent support is particularly suitable. It is optional to exclude the outer or inner diffuser. Likewise, the reflector is optional and in certain embodiments incorporating the reflector neither the inner nor the outer translucent diffuser is needed.

The present invention thus provides apparatus and method for providing a linear electromagnetic and/or sound effect.

The invention claimed is:

1. An apparatus for providing a lighting effect, comprising:

a) a plurality of light sources of a first color and a plurality of light sources of a second color arranged in a linear array and in close proximity; and b) an elongate diffuser adapted to diffuse light from the plurality of light sources so that an output from the diffuser is perceived as substantially continuous and non-pixellated;

wherein the light sources are operable to cause the light output from the diffuser to be perceived as a variety of colors.

2. The apparatus according to claim 1, wherein the light sources are selectively operated to cause the light output from the apparatus to be perceived as a single, substantially uniform color.

3. The apparatus according to claim 1, wherein the light sources are selectively operated to cause the light output from different sections of the apparatus to be perceived as different colors.

4. The apparatus according to claim 1, wherein the light sources are dynamically operated to produce dynamic lighting effects.

5. The apparatus according to claim 1, including red, green, and blue light sources.

6. The apparatus according to claim 1, including white light sources.

7. The apparatus according to claim 1, comprising at least thirty light sources.

8. The apparatus according to claim 1, further comprising control circuitry to control the light sources such that the diffused light is perceived to change color as the light sources are controlled.

9. The apparatus according to claim 1, wherein the light sources are light emitting diodes (LEDs).

10. The apparatus according to claim 1, wherein distal and proximal ends of the apparatus comprise electrical connections, so that a plurality of apparatus are connected together in a chain.

11. The apparatus according to claim 1, wherein the light sources and the diffuser are deformably mounted together so that they are configured into a desired display shape, and including a deformable support structure.

12. A method of providing a lighting effect, comprising the steps of:

a) mounting on one side of an elongate diffuser a linear array of a plurality of light sources of a first color and a plurality of light sources of a second color;

b) outputting light from the light sources of the first and second colors simultaneously via the diffuser such that light from the sources is diffused by the diffuser and perceived as a substantially continuous, non-pixellated light source; and c) controlling the light sources to cause the light output from the diffuser to be perceived as a variety of colors.

13. The method according to claim 12, further comprising selectively controlling the light sources to cause the light output from the diffuser to be perceived as a single, substantially uniform color.

14. The method according to claim 12, further comprising selectively controlling the light sources to cause the light output from different sections of the apparatus to be perceived as different colors.

15. The method according to claim 12, further comprising dynamically operating the light sources to produce dynamic lighting effects.

16. The method according to claim 12, further comprising outputting light from red, green, and blue light sources.

17. The method according to claim 12, further comprising outputting light from white light sources.

18. The method according to claim 12, further comprising outputting light from at least thirty light sources.

* * * * *